US005651151A

United States Patent [19]

Schild

[11] Patent Number: 5,651,151

[45] Date of Patent: Jul. 29, 1997

[54] ALTERNATING PRESSURE PAD

[75] Inventor: Rolf Schild, London, England

[73] Assignee: Huntleigh Technology plc, Bedfordshire, United Kingdom

[21] Appl. No.: 636,628

[22] Filed: Apr. 23, 1996

Related U.S. Application Data

[63] Continuation of Ser. No. 323,930, Oct. 17, 1994, abandoned.

[30] Foreign Application Priority Data

Oct. 19, 1993 [GB] United Kingdom ..... 9321517

[51] Int. Cl.[6] ..... A47C 27/08

[52] U.S. Cl. ..... 5/710; 5/711; 5/710

[58] Field of Search ..... 5/453, 455, 456, 5/457

[56] References Cited

U.S. PATENT DOCUMENTS

| | | | |
|---|---|---|---|
| 4,193,149 | 3/1980 | Welch | 5/453 |
| 4,225,989 | 10/1980 | Corbett et al. | 5/453 |
| 4,685,163 | 8/1987 | Quillen et al. | 5/455 |
| 4,965,899 | 10/1990 | Sekido et al. | 5/457 |
| 5,010,608 | 4/1991 | Barnett et al. | 5/453 |
| 5,044,029 | 9/1991 | Vrzalik | 5/453 |
| 5,052,067 | 10/1991 | Thomas et al. | 5/453 |
| 5,103,519 | 4/1992 | Hasty | 5/453 |
| 5,109,561 | 5/1992 | Schild | 5/453 |
| 5,117,518 | 6/1992 | Schild | 5/453 |
| 5,121,512 | 6/1992 | Kaufmann | 5/453 |
| 5,152,319 | 10/1992 | Hannagan et al. | 5/453 |
| 5,159,961 | 11/1992 | Snetting et al. | 5/453 |
| 5,233,974 | 8/1993 | Senoue et al. | 5/453 |
| 5,353,838 | 10/1994 | Arant | 5/453 |

*Primary Examiner*—Steven N. Meyers
*Assistant Examiner*—Fredrick Conley
*Attorney, Agent, or Firm*—Fitzpatrick, Cella, Harper & Scinto

[57] ABSTRACT

An alternating pressure pad has two sets of alternately inflatable cells. The alternately inflatable cells overlie additional base cells in a lower layer of the mattress. These base cells are all simultaneously inflated whilst each of the sets of upper cells are repeatedly inflated and deflated in alternation over an inflation and deflation cycle. During a cycle each set of upper cells is deflated at least once while the patient is primarily supported by the other inflated set of cells. During each inflation and deflation cycle, the additional base cells are reduced in pressure at least once. In this way, even if a part of the patient is temporarily supported only on the lower base cells, the support pressure is temporarily reduced each cycle to minimize pressure effects on the patient.

11 Claims, 2 Drawing Sheets

ALTERNATING PRESSURE PAD

This application is a continuation of application Ser. No. 08/323,930, filed Oct. 17, 1994, now abandoned.

BACKGROUND OF THE INVENTION

1. Field of the Invention

This invention relates to alternating pressure pads, and in particular alternating pressure pads of the kind used in prevention and management of decubitus ulcers in bedridden patients.

2. Description of the Prior Art

The formation of decubitus ulcers, commonly known as bedsores, results from, amongst other things, the pressure applied to certain portions of the skin of a bedridden patient. In addition, it is well known that should the lower reflex arc be broken by, for instance, lesion of the spinal cord or of nerve roots, decubitus ulcers of unusual severity and rapidity of onset are likely to develop. It is known to meet the requirement for the prevention and management of decubitus ulcers with an alternating pressure pad comprising two sets of alternately inflatable cells. The alternately inflatable sets of cells are interleaved so that the patient is supported on one inflated set of cells whilst the other set is deflated. In this way, substantially all parts of the patient body resting on the pad or mattress experience pressure relief at regular intervals. The duration of the inflation and deflation cycles may last from under two minutes for a gentle massaging effect to over twenty minutes.

The comparative advantages of different sizes and shapes of inflatable cells in such an alternating pressure pad are well known. Ideally, support provided by a given region of a pad should not be effected by the pressure applied by a patient to adjacent regions. This therefore suggests that each cell should have a relatively small width. On the other hand, each inflatable cell should have a substantial height (in the support direction of the patient), to allow a substantial amount of depression of each cell, for example for supporting heavy patients or the larger bony protuberances of even relatively light patients.

GB-B-2233552 describes an alternating pressure pad with a relatively tall cell structure which meets these conflicting requirements.

In order to maximize the pressure relieving effect on a bedridden patient, the pressure within the inflated cells supporting the patient should be as low as possible. However, it is important that no part of the body of the patient being supported depresses individual cells of the pad or mattress so much as to make contact with any underlying support surface. Sensors have been proposed which will detect when a patient's body rests against an underlying surface, and will automatically in response increase the pressure in the supporting mattress. GB-B-2233551 describes such a sensor arrangement.

One problem which is occasionally experienced with high profile alternating pressure mattresses of the kind described in GB-B-2233552 is when a portion of a patient's body slips between two adjacent inflated cells of the pad (in the position of an uninflated cell) and then rests against the underlying supporting surface. This problem arises especially when a patient is in the sitting position on the bed and can be in particular a problem for orthopedic patients under traction.

The present invention is designed to alleviate problems which can arise in this way.

SUMMARY OF THE INVENTION

According to the invention, an alternating pressure pad comprises at least two sets of successively inflatable cells, at least some of said successively inflatable cells overlying additional base cells which are all arranged for simultaneous inflation, means for successively inflating respective said sets of cells over an inflation and deflation cycle so that each set is deflated at least once during a cycle while a patient is primarily supported by at least one other inflated said set of cells, and means for partially reducing inflation pressure in said additional base cells at least once each cycle. By providing such additional base cells, at least over the portion of the mattress or pressure pad which will carry maximum patient weight, i.e. corresponding to the patient torso, the effects of parts of the patient slipping between adjacent inflated cells can be alleviated. The patient will still rest on the continuously inflated base cells. Furthermore, these base cells experience a partial reduction in pressure each cycle which can reduce any continuing risk of ulceration at this contact point.

Preferably, the inflation pressure in said additional base cells is partially reduced at least once each time during a cycle that each of said sets of cells is deflated. In this way if there are two sets of alternately inflatable cells, then the pressure in the base cells is partially reduced twice per cycle.

Conveniently, said additional base cells are all simulateneously inflated at the same pressure as the full inflation pressure of the sets of alternately inflatable cells, and said means for partially reducing operates to reduce the inflation pressure to about half of said full inflation pressure.

In another aspect, the present invention provides a pressure relief pad including a plurality of generally tubular inflatable members, at least some of said members comprising separately inflatable upper and lower part which are connected together along the length of the members, the lower parts of said members including vertically extending internal membranes to limit the height of said lower parts when inflated.

BRIEF DESCRIPTION OF THE DRAWINGS

An example of the present invention will now be described with reference to the accompanying drawings in which.

DETAILED DESCRIPTION OF THE PREFERRED EMBODIMENT

Figure 1:
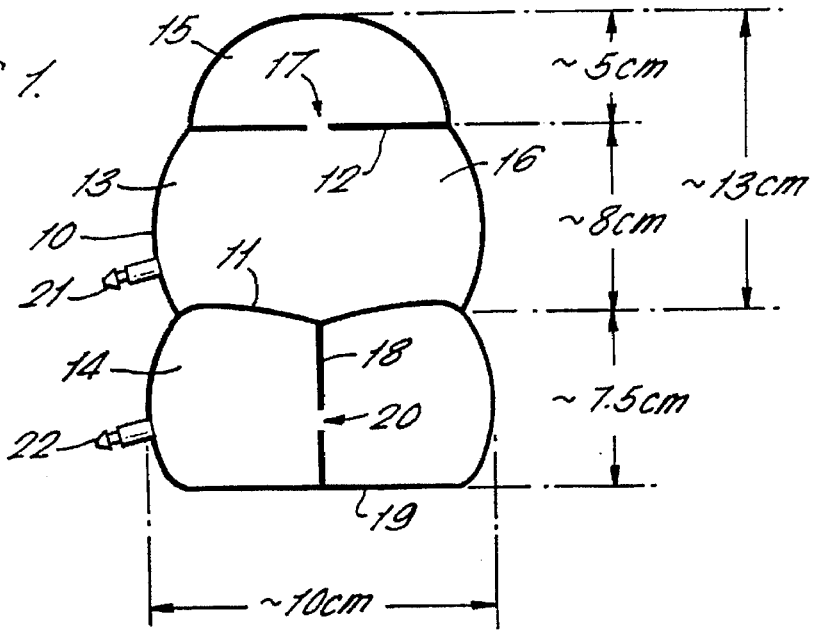
FIG. 1 is a cross sectional view of a composite cell structure for an alternating pressure pad which embodies the present invention.

Referring to FIG. 1, a composite inflatable member is shown which may form a single transverse cell of an alternating pressure mattress of the kind generally known in the art. The cell is illustrated in FIG. 1 generally in cross section and is conveniently formed from a single outer tube of flexible impervious plastics materials. The tube 10 as illustrated is divided vertically into three compartments by means of two horizontal membranes 11 and 12. The lower horizontally extending membrane 11 divides the tube 10 into separate upper and lower parts 13 and 14 which have no gas communication between them. The upper horizontally extending membrane 12 divides the upper part 13 into a smaller topmost region 15 and a larger lower region 16. However, the membrane 12 does not extend for the full length of the tubular element 10 so that the upper and lower portions 15 and 16 are in communication with each other. This is schematically illustrated in FIG. 1 by the aperture 17 shown in the membrane 12.

The lower part 14 of the tube 10 itself contains a vertically extending membrane 18 interconnecting the base of the tube 19 with the lower horizontal membrane 11. Again, the vertically extending membrane 18 includes one or more apertures, schematically shown at 20 to allow free communication between the two sides of the lower part 14.

For each transverse inflatable member as illustrated in FIG. 1, separate inflation/deflation nozzles 21, 22 are provided connecting to the upper and lower parts 13 and 14 respectively.

The purpose of the lower horizontal membrane 11 is clearly to divide the tube 10 into upper and lower parts 13 and 14 which can be separately inflated/deflated. The vertical membrane 18 is provided to limit the height to which the lower part 14 of a tube can expand when inflated. It may be understood that the lower part 14 will be inflated at a pressure above atmospheric during periods in operation when the upper part 13 will be deflated to atmospheric pressure. In the absence of the vertical membrane 18, the lower part 14 would tend to adopt a generally circular cross section which would limit the amount by which a patient's body could sink into the mattress, when suspended by adjacent inflated cells, before making contact with the lower part 14. It is to be understood that the inflated lower part is intended only to make contact with the patient in the event that a part of the patient's body slides between two adjacent inflated cells.

The upper horizontally extending membrane 12 is provided to restrict the width of the upper part of the cell. In the absence of the upper membrane 12, the upper contact face of the cell would be much wider in relation to the height of the cell. In the example described, the overall width of the cell at its widest can be confined to about 10 cms even though the upper part 13 alone of the cell may have a height of some 13 cms. The two portions 15 and 16 may have respective heights of about 5 and about 8 cms. The lower part 14 of the composite inflatable member may have a height of about 7.5 cms.

Figure 2:
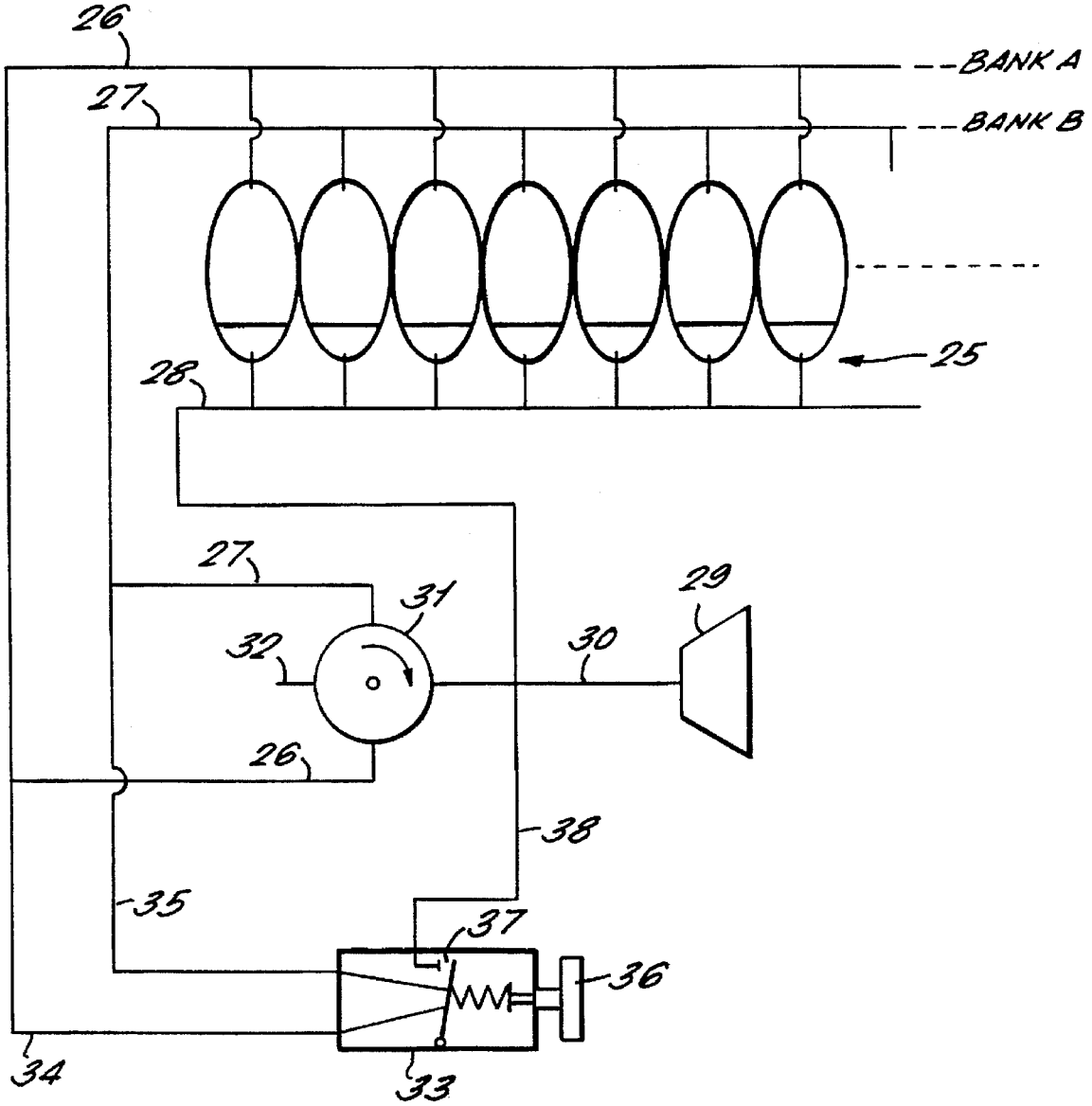
FIG. 2 is a schematic diagram illustrating an alternating pressure pad incorporating cells as shown in FIG. 1, together with the pressure control system.

Considering now FIG. 2, this shows at 25 a number of individual inflatable transverse members which may conveniently be of the form illustrated in FIG. 1. Only seven such transverse members are illustrated in FIG. 2 for convenience but a typical mattress may have twenty or more such cells to complete the length of the mattress. It will be understood that the individual cells extend transversely across the width of the mattress.

In accordance with normal practice for alternate pressure pads and mattresses, the members 25 are arranged in alternately inflatable sets or banks so that each member of one bank lies between a pair of members of the other bank. A first air supply tube 26 is connected to all the upper parts of the inflatable members of bank A, via respective nozzles 21 (FIG. 1). A second supply tube 27 is connected to all the upper parts of the inflatable members of bank B. The lower parts of all the inflatable members of both banks are connected in common to a feed tube 28.

Air to inflate the various compartments of the inflatable members of the mattress is supplied by means of a pump 29. In accordance with normal practice, the pump 29 has a limited maximum air flow rate which will define the maximum rate of increase in pressure of a bank of cells during inflation. The air outlet of the pump 29 is supplied on a line 30 to a rotary valve 31. The rotary valve may be of a known design and is arranged to connect the air feed on line 30 from the pump 29 alternately to the supply pipes 26 and 27 to the respective banks A and B of the mattress. In practice, whilst one of the banks, say bank A, is being maintained in the pressurised/inflated condition, valve 31 holds the outlet on line 30 from the pump 29 in communication with the supply pipe 26 to bank A. Meanwhile, the supply pipe bank 27 is connected by the valve 31 to atmosphere at 32. The pressure in the pressurised bank A is set by means of a pressure controller 33. The pressure controller receives the pressure in both banks A and B, via connections 34 and 35 to feed pipes 26 and 27 respectively. When the pressure in either of pipes 26 or 27 (corresponding to the pressure in the respective bank) exceeds a level set by control 36 on the pressure controller, a release valve 37 is opened in the controller to allow air from the outlet of the pump 29 to escape via line 38.

As shown in FIG. 2, the supply pipe 28 to the lower parts of the inflatable members 25 is connected directly to the outlet line 30 from the pump 29.

Figure 3:
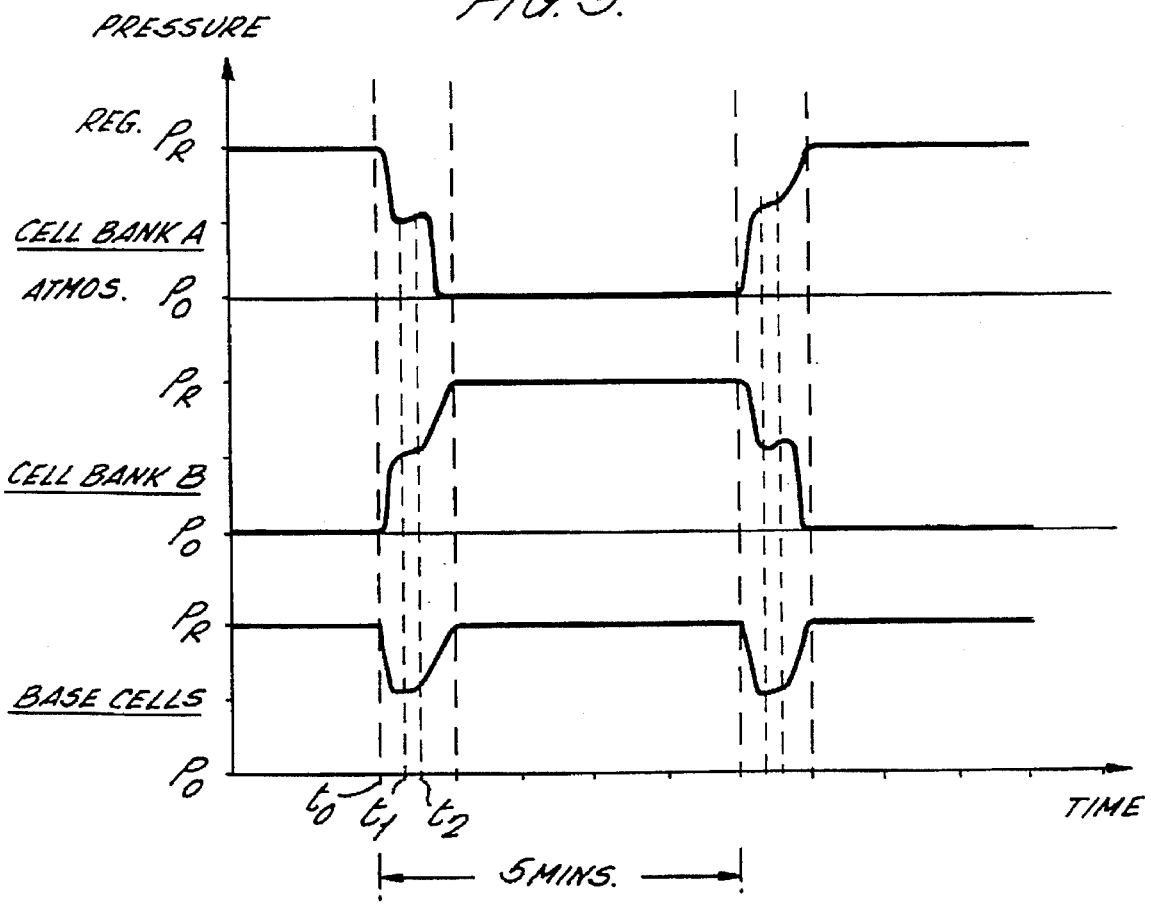
FIG. 3 is a graphical representation illustrating the timing of pressure variations in the two banks of the alternating pressure pad shown in FIG. 2, together with the base cells of the pressure pad.

The operation of the arrangement disclosed in FIG. 2 can best be understood by referring to the pressure diagrams in FIG. 3. The upper graph in FIG. 3 shows the pressure in cell bank A, while the middle graph shows the pressure in cell bank B and the lower graph shows the pressure in the base cells corresponding to the lower parts of the inflatable members 25.

Initially, the rotary valve 31 may be set so as to connect the outlet of the pump on line 30 directly to the feed pipe 26 to cell bank A. The pressure regulator 33 then controls the pressure achieved in cell bank A at $P_R$. It will be understood that this same pressure is also the pressure in the outlet line 30 of the pump 29, so that at this time the base cells are also pressurised to $P_R$. Meanwhile, the rotary valve 31 connects feed pipe 27 to cell bank B directly to atmosphere so that the pressure in the cells of bank B is at atmospheric pressure ($P_O$).

The rotary valve 31 may maintain this condition with bank A inflated and bank B deflated for say four minutes. In a practical arrangement, this timing may be adjustable. After four minutes, the rotary valve 31 first isolates feed pipe 27 from atmosphere and then progressively connects it to the air supply line 30 simultaneously with feed pipe 26 (time $t_O$ in FIG. 3). As a result, air from the inflated bank A tends to flow back along feed pipe 26 through the rotary valve 31 into feed pipe 27 to begin inflation of bank B. The limited maximum flow rate from the pump 29 is not sufficient to immediately provide the additional air needed to bring both banks A and B up to the regulated pressure $P_R$. As a result, the pressure in the two banks A and B, and also the pressure in the outlet line 30 of the pump 29 initially falls to a lower pressure, which may be about half of $P_R$. As a result, the pressure in the base cells connected by pipe 28 to the outlet of the pump 29 also falls to this lower pressure. This point is illustrated at time $t_1$ in FIG. 3.

Further rotation of the rotary valve 31 then disconnects the pump outlet line 30 from feed pipe 26, whilst maintaining connection with feed pipe 27. This point is indicated at time $t_2$ in FIG. 3. Shortly after $t_2$, feed pipe 26 is connected by the rotary valve 31 to the atmosphere at 32 so that remaining pressure in the cell bank A is lost. Once the pump outlet line 30 is connected solely to the feed pipe 27 of bank B, the pressure in bank B rises, as shown in the middle graph of FIG. 3, at the rate dependent on the maximum flow rate from the pump 29. The maximum pressure achieved in cell bank B is again controlled by regulator 33 at $P_R$.

It should be noted that the pressure at the outlet of the pump on line 30, and correspondingly the pressure in the lower parts of the inflatable members 25, the base cells, will at all times be substantially equal to the highest pressure in either of banks A or B. Accordingly, the pressure in the base cells, as illustrated in the lower graph of FIG. 3, rises from time $t_2$ in unison with the pressure in cell bank B.

It can be seen, therefore, that the pressure in the base cells of the inflatable members is partially reduced each time there is a changeover of pressurization between banks A and B. The pressure reduction achieved in the base cells corresponds to about half the regulated pressure. The duration of the reduced pressure period in the base cells depends on the "Cross-over" period, during which initially both banks of cells A and B are connected to the pump 29 and subsequently the newly inflated bank comes up to full pressure. In practice, the so called "cross-over" period may last for about one minute, so that the base cells experience a reduction in pressure for up to one minute in every five minutes.

It will be understood to those experienced in the field of pressure relief mattresses that an important feature of these pads is to ensure that for at least some part of the cycle, the contact pressure against all parts of the patient body is reduced below a threshold at which blood and lymphatic flow to surface regions of the body can be restricted. It has been found that the base cells can in the above arrangement be reduced in pressure to below the requisite threshold (to say 20 psi). Thus, even in the case of a patient sitting up on a pressure relief mattress, so that parts of the body slide between adjacent alternating pressure cells, the pressure on that protruding part of the body is restricted to the regulation pressure $P_R$ by means of the inflated base cells, and for at least a short period each half inflation cycle, is further reduced to approximately half $P_R$.

It should be understood that the reduced inflation pressure of the base cells corresponds to the beginning of the inflation period for the alternately inflatable cells immediately above them. Thus, the risk of the patient depressing the base cell right down to the underlying support layer during the reduced pressure period is minimized.

What is claimed is:

1. An alternating pressure pad comprising:

upper cells having at least first and second sets of successively inflatable cells;

additional base cells arranged for simultaneous inflation, with said upper cells distinct from said base cells so as not to be in constant fluid communication therewith and at least some of said first and second sets of cells overlying said base cells;

means for successively inflating said first and second sets of cells over an inflation and deflation cycle, so that each said set is deflated at least once during a cycle while said other set of cells is inflated; and means for partially reducing inflation pressure in said additional base cells at least once each cycle and for simultaneously inflating all of said additional base cells.

2. An alternating pressure pad as claimed in claim 1, wherein said means for partially reducing operates to reduce inflation pressure partially immediately before each of said first and second sets of cells is fully reinflated following a deflation period.

3. An alternating pressure pad as claimed in claim 2, wherein said means for partially reducing operates so that the pressure in said additional base cells is partially reduced only during the time one of said first and second sets of cells is being reinflated.

4. An alternating pressure pad as claimed in claim 1, wherein said additional base cells are all simultaneously inflated at the same pressure as the full inflation pressure of said first and second sets of alternately inflatable cells, and said means for partially reducing operates to reduce the inflation pressure to about half said full inflation pressure.

5. An alternating pressure pad as claimed in claim 1, further including a source of inflating gas having a limited maximum gas flow rate which defines the rate at which said first and second sets of cells can be inflated between deflated and fully inflated states, and a valve having a source input connected to said source and operable in accordance with a timed cycle to direct inflation gas from said source via respective outputs to each of said first and second sets in turn, said valve including a cross-over position when said source input is connected to both outputs so gas can flow from said set of cells being deflated into said set of cells being inflated, in which position the pressure in both of said first and second sets is reduced from the full inflation pressure due to the limited maximum gas flow rate, and said means for partially reducing includes a gas connection to said additional base cells from the input side of said valve so that the pressure in said base cells is reduced during the cross-over position.

6. An alternating pressure pad as claimed in claim 1, further including a plurality of generally tubular inflatable members, at least some of said members comprising separately inflatable upper and lower parts which are connected together along the length of said members, said upper and lower parts comprising respectively said overlying first and second cells and said additional base cells, with said lower parts of said members including vertically extending internal membranes to limit the height of said lower parts when inflated.

7. An alternating pressure pad as claimed in claim 6, wherein said upper parts are of greater height than width and each comprise at least one horizontally extending internal membrane to limit the width of said upper part when inflated.

8. An alternating pressure pad as claimed in claim 6, wherein said upper and lower parts of each member are divided by a horizontally extending internal membrane between side walls of each said member.

9. An alternating pressure pad comprising:

upper cells having at least first and second sets of successively inflatable cells;

additional base cells arranged for simultaneous inflation, with said upper cells distinct from said base cells so as not to be in constant fluid communication therewith and at least some of said first and second cells overlying said base cells;

an inflation controller for successively inflating said first and second sets of cells over an inflation and deflation cycle, so that each said set of cells is deflated at least once during a cycle while the other said set of cells is inflated; and an inflation supply connected to said additional base cells and adapted for partially reducing the inflation pressure of said base cells at least once each cycle and for simultaneously inflating all of said additional base cells.

10. An inflatable cell for an alternating pressure mattress, the cell comprising:

a single outer tube of flexible impervious plastic material, said outer tube having first and second horizontal membranes dividing said tube into three compartments, said first horizontal member dividing said tube into separate upper and lower portions having no gas communication therebetween, and said second horizontal membrane dividing said upper portion into a topmost region and a lower region, with said second horizontal membrane allowing for fluid communication between said topmost and lower regions, and a vertically extending membrane interconnecting a base of said tube with said first horizontal membrane, said vertically extending membrane allowing fluid communication between first and second sides of said lower portion.

11. An inflatable cell according to claim 10, wherein said topmost region is smaller than said lower region.

* * * * *

UNITED STATES PATENT AND TRADEMARK OFFICE

CERTIFICATE OF CORRECTION

PATENT NO. : 5,651,151
DATED : July 29, 1997
INVENTOR(S) : Schild

It is certified that error appears in the above-identified patent and that said Letters Patent is hereby corrected as shown below:

On title page, item

[56] REFERENCES CITED:

U.S. PATENT DOCUMENTS, insert the following:

--4,777,679 10/1988 DeLooper ..... 5/453
5,243,723 9/1993 Cotner et al. ..... 5/453--.

FOREIGN PATENT DOCUMENTS, insert the following:

--2197192 5/1988 United Kingdom
1602952 11/1981 United Kingdom
1599422 9/1981 United Kingdom--.

COLUMN 2:

Line 35, "part" should read --parts--.

Signed and Sealed this

Twenty-first Day of April, 1998

Bruce Lehman

*Attest:*

BRUCE LEHMAN

*Attesting Officer*

*Commissioner of Patents and Trademarks*